United States Patent [19]

Ogasa et al.

[11] 4,142,916

[45] Mar. 6, 1979

[54] METHOD FOR PREPARING A NON-HYGROSCOPIC LACTULOSE-CONTAINING POWDER

[75] Inventors: Katsuhiro Ogasa; Mamoru Tomita, both of Yokohama; Teruhiko Mizota, Tokyo, all of Japan

[73] Assignee: Morinaga Milk Industry Co., Ltd., Tokyo, Japan

[21] Appl. No.: 902,752

[22] Filed: May 3, 1978

[30] Foreign Application Priority Data

May 26, 1977 [JP] Japan ..... 52-61675

[51] Int. Cl.[2] ..... C13K 13/00; C13F 1/14

[52] U.S. Cl. ..... 127/63; 127/30

[58] Field of Search ..... 127/30, 31, 63

[56] References Cited

U.S. PATENT DOCUMENTS 3,445,283 5/1969 Amano et al. ..... 127/63 X 3,546,206 12/1970 Guth et al. ..... 127/30 X

FOREIGN PATENT DOCUMENTS 1232554 5/1971 United Kingdom ..... 127/30

*Primary Examiner*—Morris O. Wolk

*Assistant Examiner*—Roger F. Phillips

*Attorney, Agent, or Firm*—Oblon, Fisher, Spivak, McClelland & Maier

[57] ABSTRACT

Method for manufacturing a lactulose powder with a low hygroscopicity by mixing ethyl alcohol to a highly hygroscopic lactulose-containing powder followed by allowing the resulting mixture to stand or stirring it for at least 1 hour, separating the lactulose-containing material insoluble in ethyl alcohol from the mixture and removing ethyl alcohol from the material separated.

3 Claims, No Drawings

METHOD FOR PREPARING A NON-HYGROSCOPIC LACTULOSE-CONTAINING POWDER

BACKGROUND OF THE INVENTION

1. Field of the Invention

The invention is in the field of manufacturing a lactulose powder. Particularly, the invention relates to a method for manufacturing a highly purified lactulose powder less hygroscopic than that obtained by any methods of prior art.

2. Description of the Prior Art

Trials have been carried out for several decades in the past with an object of separating purified lactulose from a syrup containing lactulose by crystallization. For example, Montgomery et al. (Journal of the American Chemical Society, 52, 2101, 1930), Whistler et al., ("Methods in Carbohydrate Chemistry," edited by Whistler et al., Volume 1, Page 325, Academic Press, New York and London, 1962) and Adachi Nyugikyo Shiryo (Bulletin of Japan Dairy Technical Association), Volume 22, No. 2, Page 3, 1972) gave detailed description. However, these methods have a drawback that they cannot be put into practice use industrially despite of their effectiveness as experimental methods because of their complexity and the use of methyl alcohol which is toxic to human and which cannot be removed absolutely . Further, there are no prior arts of using only ethyl alcohol in the treatment of lactulose syrups or lactulose powders, because pure lactulose crystals cannot be obtained by adding ethyl alcohol to a syrup containing lactulose differing from the case of adding methyl alcohol. Therefore, a drying method using lactulose syrups has been carried out hitherto industrially instead of the crystallization method considering the difficulties in the crystallization of lactulose. As for the methods for manufacturing a lactulose-containing powder from a lactulose syrup with a higher content of lactulose, several methods are known at the present time. They are, for instance, a method of spray-drying of the syrup as it is regardless of the yield, a drying method up of the syrup admixed with a drying aid such as a grain flour (Japanese Patent Publication Gazette No. 861/65), konjak powder (Japanese Patent Publication Gazette No. 44331/74) or a protein (Japanese Patent Publication Gazette No. 44332/74) and a method of freeze-drying of the syrup (Japanese Patent Publication Gazette No. 54556/74).

However, there is an inconvenience that the grain flour, the konjak powder or the protein is included in the powder as the final product in the manufacturing by the methods using a drying aid as described in the above. The methods without use of any drying aid have some drawbacks such as the decrease of the yield and the increase of the manufacturing cost. Further, the powders containing lactulose obtained by any of the above-mentioned methods have a drawback that they are so highly hygroscopic that are apt to agglomerate by absorbing moisture in an ambience of room temperature and of ordinary humidity despite of the low content of moisture in the powders. Therefore, there is an inconvenience that treatment in a room with a low humidity is required in packaging of the powders or in tablet-forming of the powders prepared by these methods, and further, there are some difficulties in the preservation and in the packaging for the storing over a long term due to the high hygroscopicity.

SUMMARY OF THE INVENTION

The present invention relates to a method for preparing a non-hygroscopic lactulose-containing powder in a high purity by treating a highly hygroscopic lactulose-containing powder with ethyl alcohol.

The object of the present invention is to provide a method for preparing a powder containing lactulose in a high purity such as at least 55% (by weight, same hereinafter) and which does not agglomerate even in being placed in a room with an ordinary humidity at room temperature by absorption of the moisture.

The non-hygroscopic lactulose-containing powder prepared by the method of the present invention is not consisted of pure crystal of lactulose, but it is a powder containing partially crystallized lactulose as a principal component and, in addition, sugars such as lactose, galactose and the like.

The inventors of the present invention investigated method for manufacturing a non-hygroscopic lactulose-containing powder in a large amount by eliminating the drawbacks accompanied by the aforementioned methods of the prior art. And the present inventors have found a fact that a non-hygroscopic lactulose-containing powder can be manufactured by treating a highly hygroscopic lactulose-containing powder with ethyl alcohol under a specific condition.

Thus, according to the present invention the object of the present invention has been accomplished by a method for preparing a non-hygroscopic lactulose-containing powder, in particular in a large amount, characterized by comprising the steps:

(1) adding at least 0.8 part by weight of ethyl alcohol to 1 part by weight of highly hygroscopic lactulose-containing powder the lactulose content of which is above 55% by weight while adjusting the amount of ethyl alcohol to be added so that the water content in mixture is below 2% by weight;

(2) allowing the resulting mixture to stand or stirring it at a temperature below the boiling point of ethyl alcohol for at least 1 hour, and cooling, if necessary;

(3) separating an ethyl alcohol insoluble lactulose-containing material precipitated; and (4) removing ethyl alcohol from said material.

DETAILED DESCRIPTION OF THE PREFERRED EMBODIMENTS

A highly hygroscopic powder containing at least 55% of lactulose is prepared by spray-drying of a syrup containing lactulose by a known method such as the method specified in either Japanese Patent Publication Gazette No. 44331/74 or Japanese Patent Publication Gazette No. 44332/74, the syrup being manufactured by any of the known methods, preferably by the method specified in Japanese Patent Publication Gazette No. 2984/77. The content of water in the powder thus obtained is usually 3% or less. Otherwise, a similar lactulose-containing powder can be obtained by freeze-drying of the above lactulose-containing syrup by a method specified in the Japanese Patent Public Disclosure No. 54556/74.

Any of the highly hygroscopic lactulose-containing powder prepared according to the above-mentioned methods can be used in the method of the present invention, but it is preferable to use a powder containing lactulose as much as possible and containing water as little as possible.

The ethyl alcohol used in the method of the present invention should be a reagent-grade ethyl alcohol or a purified product using the former which contains no toxic substances to human, and ethyl alcohol containing water as little as possible is preferred.

Then 1 part (by weight, same hereinafter) of the aforementioned highly hygroscopic lactulose-containing powder is added with at least 0.8 part of ethyl alcohol under a condition that the content of water in the mixture is controlled so as not to exceed 2% by adjusting the amount of ethyl alcohol added. No particular means is required in order to adjust the content of water in the mixture by adding ethyl alcohol to the lactulose powder, but the adjusting is carried out by a calculation based on the amount of the lactulose powder used and the amount of ethyl alcohol added to the lactulose powder, and assay of water in the ethyl alcohol and the lactulose powder.

The amount of water contained in the mixture was determined according to the following testings.

(TESTING 1)

The highly hygroscopic lactulose powder used in this testing was prepared according to the method of Example in Japanese Patent Public Disclosure Gazette No. 54556/74, repeatedly in Example 1 of the present invention, and contained 0.5% of water, 77.8% of lactulose and 21.7% of other sugars (galactose, lactose and the like). On the other hand, aqueous solutions of ethyl alcohol with varied concentrations as 98.5%, 98.0%, 97.5%, 97.0% and 96.5%, respectively, of ethyl alcohol were prepared by adding corresponding amounts of water to absolute ethyl alcohol. Each 20g portion of the above aqueous ethanol solutions with varied concentrations was added to 10g of the aforementioned lactulose powder and the mixture obtained were kept at 30° C. for 24 hours with stirring. Then the lactulose-containing masses insoluble in ethyl alcohol were separated by filtration, almost all of the ethyl alcohol was removed from the lactulose composites under a reduced pressure, and the powders thus obtained containing lactulose were tested immediately after the preparation by observing the properties with the naked eyes.

The testing results are shown in Table 1.

Table 1

| sample No. | (A) water content in lactulose powder (%) | (B) water content in ethyl alcohol (%) | water content in the mixture of (A) and (B) (%) | properties of the powder obtained |
|---|---|---|---|---|
| 1 | 0.5 | 0 | 0.17 | flowable white powder |
| 2 | 0.5 | 1.5 | 1.17 | " |
| 3 | 0.5 | 2.0 | 1.50 | " |
| 4 | 0.5 | 2.5 | 1.83 | slightly flowable white powder |
| 5 | 0.5 | 3.0 | 2.16 | white agglomerated mass without flowability |
| 6 | 0.5 | 3.5 | 2.50 | viscous mass like corn syrup with yellow color |

As obviously seen in Table 1, the powders thus obtained had no flowability, and the properties of them were similar to those of the powder prepared by any method of prior art in a moistened condition when the contents of water in the mixtures of lactulose and ethyl alcohol exceeded 2%. And flowable powders were obtained when the contents of water in the mixtures were 2% or less.

By the way, the testings of hygroscopicity for the powders obtained during storage were not carried out in Testing 1, because the properties of the powders were greatly different from each others even at the time immediately after preparation and it was apparent without testings for hygroscopicity that the samples of the powders No. 5 and No. 6 did not satisfy the object of the present invention.

Furthermore, 10g portions of highly hygroscopic lactulose-containing powders with various contents of water prepared by freeze-drying were added with 10g of absolute ethyl alcohol and treated in the same manner as in Testing 1 thus giving a testing result similar to that of Table 1 in that flowable powders could be obtained when the contents of water in the mixtures of lactulose powder and ethyl alcohol were 2% or less and the obtained powders were not flowable and had similar hygroscopicity to the lactulose powders prepared by any of the methods of prior art when the water-contents of the mixture exceeded 2%.

It was concluded from the above testing results that the content of water in the mixture of lactulose powder and ethyl alcohol should be essentially 2% or less.

Next, 1 part of the highly hygroscopic powder containing lactulose prepared according to the aforementioned manner is added with at least 0.8 part of ethyl alcohol and kept still or with stirring at least for 1 hour at the temperature not exceeding the boiling temperature of ethyl alcohol. Use of a large amount of ethyl alcohol is not preferred because of the expensiveness of ethyl alcohol and the decrease of the yield of the lactulose powder with a low hygroscopicity.

However, drying aids are contained in the lactulose powders prepared by the aforementioned methods described in the Gazettes of Japanese Patent Publication Gazette Nos. 861/65, 44331/74 and 44332/74, and it is necessary to add enough amount of ethyl alcohol for dissolving the lactulose once perfectly in order to remove the drying aids by any method such as filtration. In these cases it is necessary to form a lactulose-containing material insoluble in ethyl alcohol by keeping the filtrate at a low temperature with or without concentration following to the removing of the drying aids by separation from the ethyl alcohol solution of lactulose.

On the other hand, less amounts of ethyl alcohol, that is, at least 0.8 part, preferably from 1.5 to 2.0 parts of ethyl alcohol are added to 1 part of highly hygroscopic lactulose powder in the cases of using a highly hygroscopic lactulose powder prepared by spray-drying according to the method of the aforementioned prior art or using a highly hygroscopic lactulose powder not containing any drying aids prepared by the method described in Japanese Patent Public Disclosure Gazette No. 54556/74 since they do not contain any components other than sugars including lactulose, lactose, galactose and the like. When the amount of ethyl alcohol is less than 0.8 part, the method of the present invention cannot be put into practice because of the lack of the uniformity in the immersion of lactulose powder in ethyl alcohol. Alternatively, the method of seeding a powder of lactulose crystals separately prepared may be used. The mixture is kept still or with stirring at a temperature of 65° C. or below, preferably at about 30° C., after being added with ethyl alcohol. The duration of keeping still or stirring varies in accordance with the amounts of ethyl alcohol added and is, for instance, at least 1 hour for 15 parts of ethyl alcohol added and at least 24 hours for 1.2 parts of ethyl alcohol added, and further, from 24 to 48 hours for from 1.5 to 2.0 parts of ethyl alcohol added in the most preferable mode of the method.

It is necessary to stir the mixture powerfully when the temperature to keep the mixture exceeds 65° C., because the powder containing lactulose dissolves in the mixture to form a viscous mass like a corn syrup. On the other hand, a treatment at an extremely low temperature is not preferable because of the extention of the time required for keeping still or stirring. Therefore, the most desirable temperature for keeping the mixture is about 30° C.

Next, the lactulose-containing material insoluble in ethyl alcohol is separated from the above mixture. The separation is carried out by any of the conventional methods such as filtration, centrifuging and the like. The separated lactulose-containing material insoluble in ethyl alcohol is then dried under a reduced pressure or in vacuum at a temperature of 60° C. or below as usual to remove ethyl alcohol completely thus forming a lactulose-containing powder having non-hygroscopicity.

The following descriptions are the examples of the testings for hygroscopicity carried out on the non-hygroscopic lactulose-containing powders obtained according to the method of the present invention in comparison with the highly hygroscopic lactulose-containing powders according to the methods of prior art.

(TESTING 2)

(1) Preparation of sample

A lactulose syrup was spray-dried according to the method similar to Example 2 of the present invention to obtain a highly hygroscopic lactulose-containing powder with a composition of 77.3% of lactulose, 1.2% of water and 21.5% of other sugars (such as lactose, galactose and the like). Then, the following four kinds of sample (Samples No. 1 to No. 4) prepared by the method according to the present invention were tested using the above powder (Sample No. 6) and Sample No. 5 prepared by the method shown below as the controls.

(i) Sample No. 1

Adding 1.2 parts of ethyl alcohol with a concentration of 99.8% to 1 part of the aforementioned powder to obtain a mixture with 0.6% of the controlled content of water, the mixture was further added with a small amount of powder of lactulose crystals separately prepared and allowed to stand for 66 hours at 30° C., and then the lactulose-containing material insoluble in ethyl alcohol was separated from the mixture by filtration and dried by removing almost all of the ethyl alcohol at a temperature of 50° C. under a reduced pressure. The sample had a melting point in the range of from 139° to 151° C. (according to "Fieser: Experiments in Organic Chemistry" pages 17 to 20, written by Fieser, translated by Yoshimasa Hirata and Koji Nakanishi, Maruzen Co., Tokyo, 1967) and contained 78.1% of lactulose (by the Method of Sweeley: Journal of the American Chemical Society, 85, 2497, 1963) and 0.1% of water, and the yield (the percentage of the weight of the powder obtained versus the weight of the powder used) was 93.5%.

(ii) Sample No. 2

This sample was prepared by the method similar to Sample No. 1 except that the content of water in the mixture was controlled to 0.5% by adding 2 parts of the aforementioned ethyl alcohol and the mixture was stirred at 35° to 40° C. for 48 hours. The sample had a melting point in the range of 142° to 157° C. and 80.1% and 0.1% of the contents of lactulose and water, respectively, and the yield was 91.4%.

(iii) Sample No. 3

This sample was prepared by the method similar to Sample No. 1 except that the content of water in the mixture was controlled to 0.4% by addZing 4 parts of the aforementioned ethyl alcohol. The sample had a melting point in the range of 144.5° to 160° C. and 81.6% and 0.1% of the contents of lactulose and water, respectively, and the yield was 90.2%.

(iv) Sample No. 4

This sample was prepared by the method similar to Sample No. 1 except that the content of the water in the mixture was controlled to 0.3% by adding 15 parts of the aforementioned ethyl alcohol and the mixture was stirred at 60° C. for 5 hours and then allowed to stand at 10° C. for 24 hours to form a lactulose-containing material insoluble in ethyl alcohol. The sample had a melting point in the range of 150° to 162° C. and 88.5% and 0.1% of the contents of lactulose and water, respectively, and the yield was 61.9%.

(v) Sample No. 5

This sample was prepared by the method similar to Sample No. 2 except that the content of water in the mixture was controlled to 2.4% by adding 2 parts of ethyl alcohol of 97% concentration. The sample had a melting point in the range of 130° to 137° C. and 79.1% and 0.4% of the contents of lactulose and water, respectively, and the yield was 88.5%.

(2) Testings for the hygroscopicity corresponding to the variation of the relative humidity Ten gram portions of the above Samples No. 1 and No. 6 were put into each 3 Petri dishes and placed at a temperature of 25° C., 10, 20, 30, 40, 55, 65 or 75% in relative humidity for 2 days without covering. At the end of the testing period, the powders in every Petri dishes were weighed and the degrees of the hygroscopicity of each sample corresponding to the humidity were determined as the average values of the ratios of hygroscopicity represented in percentages for each sample obtained by dividing the differences of the weights of the powders before and after the testings by the weights of the powders before the testings.

(3) Testings for the hygroscopicity corresponding to the days of storage

The testings were carried out for Samples No. 2 to No. 6 in a manner similar to the above (2) by placing the samples at a temperature of 25° C. in a relative humidity of 60% for 5 days, and the degrees of the hygroscopicity corresponding to the days of storage were estimated for each sample on the basis of the ratios of hygroscopicity determined as above.

The testing results are shown in Table 2 and Table 3.

Table 2

| Sample | relative humidity (%) | | | | | | |
|---|---|---|---|---|---|---|---|
| No. | 10 | 20 | 30 | 40 | 55 | 65 | 75 |
| 1 | 0 | 0 | 0 | 0 | 1.2 | 4.8 | 13.4 |
| 6 | 1.4 | 2.3 | 5.5 | 6.0 | like corn syrup | — | — |

Table 3

| Sample No. | days of storage 1 | 2 | 3 | 5 |
|---|---|---|---|---|
| 2 | 2.5 | 4.1 | 4.9 | 5.3 |
| 3 | 4.1 | 5.6 | 6.3 | 6.8 |
| 4 | 3.4 | 4.9 | 5.2 | 5.2 |
| 5 | 6.9 | 9.3 | 10.4 | 11.4 |
| 6 | — | 10.9* | — | — |

*The sample was extremely hygroscopic and formed a highly viscous mass like corn syrup.

As distinctly understood from Table 2, the lactulose-containing powder prepared by the method according to the present invention did not absorb moisture altogether when placed in an atmosphere with a relative humidity of 40% for 2 days, while on the other hand the powder prepared by the method of prior art absorbed 6% of moisture when placed in the same condition even with a relative humidity of 40% and showed appearance of corn-syrup when the relative humidity was 55%. Therefore, it is apparent that the lactulose-containing powder obtained by the method of the present invention has a markedly lower hygroscopicity than the powders obtained by the methods of prior art.

Furthermore, as distinctly understood from the data of the ratios of hygroscopicity corresponding to the varied days of storage under an equal humidity as shown in Table 3, the lactulose-containing powders prepared by the method of the present invention absorbed only 5 to 7% of moisture even after 5 days' storage, while the powders by the method of prior art already became a viscous mass like corn syrup after 2 days' storage. Also, even the powders prepared by means of a treatment with ethyl alcohol like the method of the present invention gave ratios of hygroscopicity 1.7 to 2.8 times larger than that of the powder by the method of the present invention when the treatment of the powder was carried out under a condition that the content of water in the mixture of a hygroscopic powder containing lactulose and ethyl alcohol exceeded 2%. Accordingly, it is obvious that the method of the present invention gives markedly surpassing effects above the method of the prior art from the testing results in Table 3, too.

The effects given by the method of the present invention are summarized as follows:

(1) A lactulose-containing powder with an extremely low hygroscopicity is obtained.
(2) The process is extremely simplified and no reagent harmful to human bodies is used.
(3) Loss of the lactulose is absent and the yield is high, because lactulose does not decompose througout the process.

EXAMPLE 1

A lactulose syrup with a composition of 52.8% of lactulose, 14.7% of other sugars (galactose, lactose and the like) and 32.5% of water in an amount of 2.0kg was flowed over a drying pan for the shelf-type freeze-drier forming a layer with a thickness of 5mm, and was subjected to freeze drying initially with −40° C. of the shelf temperature and 1mmHg of the degree of vacuum for 2 hours. Then, the shelf temperature was adjusted to −30° C. again and in succession raised gradually until it reached 80° C. after 4 hours. The degree of vacuum decreased gradually to 30mmHg during the operation. Thereafter, the shelf temperature was adjusted to 35° C. extending over about 2 hours and drying was continued for 15 hours at this temperature. The thus obtained powder was finally crushed down to obtain 1.3kg of freeze-dried lactulose powder which is highly hygroscopic and with a composition of 0.5% of water, 77.8% of lactulose and 21.7% of other sugars. (The method of the Example in Japanese Patent Public Disclosure Gazette No. 54556/74.)

The powder thus obtained in an amount of 1.0kg was added with 0.8kg of commercially available ethyl alcohol containing 0.7% of water to adjust the content of water in the mixture to 0.6%, and the mixture was stirred at 30° C. for 48 hours. Then the lactulose-containing material insoluble in ethyl alcohol was separated by filtration and dried under a reduced pressure at 50° C. as usually to obtain about 0.94kg of white powder containing lactulose. The powder contained 78.3% of lactulose and had properties with a low hygroscopicity as evidenced by a fact that it did not agglomerate even after 2 days' standing under 60% of the relative humidity.

EXAMPLE 2

A lactulose syrup with a composition of 52.8% of lactulose, 14.7% of other sugars (galactose, lactose and the like) and 32.5% of water was spray-dried by a known method to obtain a highly hygroscopic lactulose-containing powder with a composition of 1.2% of water, 77.3% of lactulose and 21.5% of other sugars.

The lactulose-containing powder in an amount of 1.0kg was added with 2.0kg of commercially available ethyl alcohol containing 0.7% of water to adjust the content of water in the mixture to 0.9%, and the mixture was stirred at 25° C. for 36 hours. Then the lactulose-containing material insoluble in ethyl alcohol was separated by filtration and dried under a reduced pressure at 50° C. as usual thus giving about 0.90kg of lactulose-containing powder.

The powder contained 80.4% of lactulose and had properties with low hygroscopicity as evidenced by a fact that it did not agglomerate even after 2 days' standing under 60% of the relative humidity.

EXAMPLE 3

A lactulose syrup with a composition of 52.8% of lactulose, 14.7% of other sugars (galactose, lactose and the like) and 32.5% of water in an amount of 3kg was added with a filtrate obtained by removing insoluble matters using a 100 mesh filter cloth from the mixture prepared by adding 1.5 liter of water to 7.9g of commercially available konjak powder (a product in Fukushima, Japan: a refined powder) corresponding to 0.5% of the lactulose in the syrup and stirring to swell uniformly, and mixed uniformly. The liquid mixture thus obtained was heated to 45° C. and spray-dried using a spray-drier (manufactured by Anhydro Company) under the condition of 170° C. of temperature at hot-air inlet, 90° C. of exhaust temperature and 9,000 r.p.m. of rotating rate of the atomizer thus giving about 1.7kg of a highly hygroscopic lactulose-containing powder with a composition of 0.5% of water, 77.5% of lactulose and 22.0% of other components (the method of Example 1 described in Japanese Public Publication Gazette No. 44331/74).

The lactulose-containing powder thus obtained in an amount of 1.0kg was added with 15.0kg of ethyl alcohol containing water controlled to 1.8% to adjust the content of water in the mixture to 1.7%, and the insoluble matter was filtered in hot after continuation of stirring at 60° C. for 2 hours. The filtrate was cooled to 5° C. and stirred for 24 hours to form a lactulose-containing material insoluble in ethyl alcohol. The thus formed lactulose-containing material insoluble in ethyl alcohol was then separated by filtration and dried under a reduced pressure at 50° C. as usual thus giving about 0.50kg of a lactulose-containing powder.

The powder contained 89.0% of lactulose and had properties with a low hygroscopicity as evidenced by the fact that it did not agglomerate even after 2 days' standing under 60% of the relative humidity.

What is claimed is:

1. A method for preparing a non-hygroscopic lactulose-containing powder characterized by comprising the steps:

(1) adding at least 0.8 part by weight of ethyl alcohol to 1 part by weight of highly hygroscopic lactulose-containing powder the lactulose content of which is above 55% by weight while adjusting the amount of ethyl alcohol to be added so that the water content in mixture is below 2% by weight;

(2) allowing the resulting mixture to stand or stirring it at a temperature below the boiling point of ethyl alcohol for at least 1 hour, and cooling, if necessary;

(3) separating an ethyl alcohol insoluble lactulose-containing material precipitated; and (4) removing ethyl alcohol from said material.

2. The method for preparing a non-hygroscopic lactulose-containing powder as set forth in claim 1 wherein the rate of ethyl alcohol added is 1.5 to 2.0 parts by weight to 1 part by weight of highly hygroscopic lactulose-containing powder.

3. The method for preparing a non-hygroscopic lactulose-containing powder as set forth in claim 1 wherein said mixture is allowed to stand or stirred at a temperature of 30° C. for 24 to 48 hours.

* * * * *